United States Patent [19]

Miller et al.

[11] 4,083,649

[45] Apr. 11, 1978

[54] COOLING SYSTEM FOR TURBOMACHINERY

[75] Inventors: Arthur J. Miller, North Huntington; J. Rodger Shields, Pittsburgh, both of Pa.

[73] Assignee: Carrier Corporation, Syracuse, N.Y.

[21] Appl. No.: 683,360

[22] Filed: May 5, 1976

[51] Int. Cl.[2] ..... F01D 25/12; F04D 29/58

[52] U.S. Cl. ..... 415/116; 415/175; 415/178

[58] Field of Search ..... 415/178, 114, 116, 115, 415/175; 60/39.54, 39.58, 39.66; 165/114, 42

[56] References Cited

U.S. PATENT DOCUMENTS

| | | | |
|---|---|---|---|
| 1,297,803 | 3/1919 | Davis | 415/116 |
| 1,708,031 | 4/1929 | Rathbun | 165/114 |
| 1,776,832 | 9/1930 | Holzwarth | 60/39.54 |
| 2,414,840 | 1/1947 | Streid | 415/178 X |
| 2,429,990 | 11/1947 | Burgess | 415/178 UX |
| 2,468,461 | 4/1949 | Price | 415/116 UX |
| 2,479,573 | 8/1949 | Howard | 415/116 UX |
| 2,552,239 | 5/1951 | Warren | 415/116 X |
| 2,648,519 | 8/1953 | Campini | 415/115 |
| 2,806,355 | 9/1957 | Schörner | 415/115 |
| 2,831,653 | 4/1958 | Alford | 415/175 |
| 2,988,325 | 6/1961 | Dawson | 415/115 |

FOREIGN PATENT DOCUMENTS

| | | | |
|---|---|---|---|
| 1,820,725 | 8/1931 | United Kingdom | 60/39.66 |

*Primary Examiner*—Carlton R. Croyle
*Assistant Examiner*—Donald S. Holland
*Attorney, Agent, or Firm*—J. Raymond Curtin; Barry E. Deutsch

[57] ABSTRACT

A turbomachine includes a casing having a rotor mounted therein. The casing includes an assembly with provisions for admitting a cooling medium. The assembly comprises a first member having opposed front and rear spaced, radially extending walls. A baffle member extends radially within a chamber defined by said spaced walls. The baffle member includes a plurality of equally spaced circumferential openings defining a fluid flow path for cooling medium injected into said chamber. If the fluid is in a saturated state prior to its injection into the chamber, the fluid is expanded into a superheated state at the chamber entrance. The fluid is directed by the baffle member to the outer diameter of the chamber, then radially inward through the flow path. The fluid exits from the first member through a circular gap having the top surface thereof defined by the lower inner surface of the rear wall of the first member.

7 Claims, 4 Drawing Figures

COOLING SYSTEM FOR TURBOMACHINERY

BACKGROUND OF THE INVENTION

This invention relates to improvements in turbomachinery and in particular, to an improved structure for admitting a cooling medium thereinto.

There are many known manufacturing applications wherein large quantities of relatively high temperature (for example 1,000° - 1,200° F) waste gas are discharged as a result of the particular process involved in such application. To achieve an increase in the efficiency of the process, and more importantly, to conserve energy, it is extremely desirable to employ the high temperature waste gas to drive a power recovery turbomachine. Heretofore, there have been many problems associated with power recovery applications of this type due to the general nature of the waste gas used as the motivating fluid. For example, the gas very often is "dirty" due to large quantities of foreign particles entrained therein. To prevent rapid erosion of the various parts of the turbomachine, separators or similar equipment have been employed to remove the foreign particulate matter entrained in the gas stream prior to its entry into the turbomachine.

Additionally, due to the relatively high temperature at which the gas is delivered to the machine, it is generally necessary to supply a cooling medium thereto to maintain the components thereof below critical temperatures. The waste gas is almost always flammable; therefore, it is necessary that the cooling medium be an inert gas to prevent ignition of the waste gas within the turbomachine. Since steam is generally available at applications employing power recovery machines of the type under discussion, the steam may be utilized as the cooling medium. As the temperature of the various components of the turbomachine are operating at relatively high temperatures, it is necessary that the steam be admitted into the machine in a manner whereby localized overheating or overcooling of any of the components is prevented. To achieve the foregoing desiderata, the steam should preferably be placed in a substantially superheated state prior to its contacting any of the turbomachine's relatively hot components. Furthermore, the velocity of the cooling medium should be maintained at a substantially high rate to obtain convection cooling of the components.

SUMMARY OF THE INVENTION

It is accordingly an object of this invention to admit cooling fluid into a power recovery turbomachine without causing localized component distortion.

It is a further object of this invention to include a novel assembly in a turbomachine which provides an admission path for cooling medium delivered to the turbomachine.

It is a further object of this invention to maintain the cooling medium at a sufficiently high velocity as it passes over the components of the turbomachine to obtain convection cooling.

It is yet another object of this invention to provide a structure for sealing one end of a casing of a turbomachine, said structure defining an admission path for cooling medium delivered to the turbomachine.

It is another object of this invention to admit a saturated cooling fluid into a power recovery turbomachine without causing localized component distortion by expanding the cooling medium through a critical flow orifice.

These and other objects of the instant invention are attained in a turbomachine which includes a casing having a rotor mounted therein. The casing includes an assembly for admitting a cooling medium. The assembly comprises a first member having opposed front and rear spaced, radially extending walls. A baffle member extends radially within a chamber defined by said spaced walls. The baffle member includes a plurality of equally spaced, circumferentially extending openings defining a fluid flow path for cooling medium injected into said chamber. The cooling medium is expanded at the chamber entrance to place said medium in a superheated state. The cooling medium is initially directed by the baffle member to the outer diameter of the chamber, then radially inward through the flow path. The cooling medium exits from the first member through a circular gap having the top surface thereof defined by the lower inner surface of the rear wall of the first member. In a preferred embodiment of the instant invention, the structure is employed for sealing one end of the turbomachine's casing.

DESCRIPTION OF THE PREFERRED EMBODIMENT

Referring now to the various figures of the drawings, a preferred embodiment of the present invention will be described in detail. In referring to the various figures, like numerals shall refer to like parts.

Figure 1:
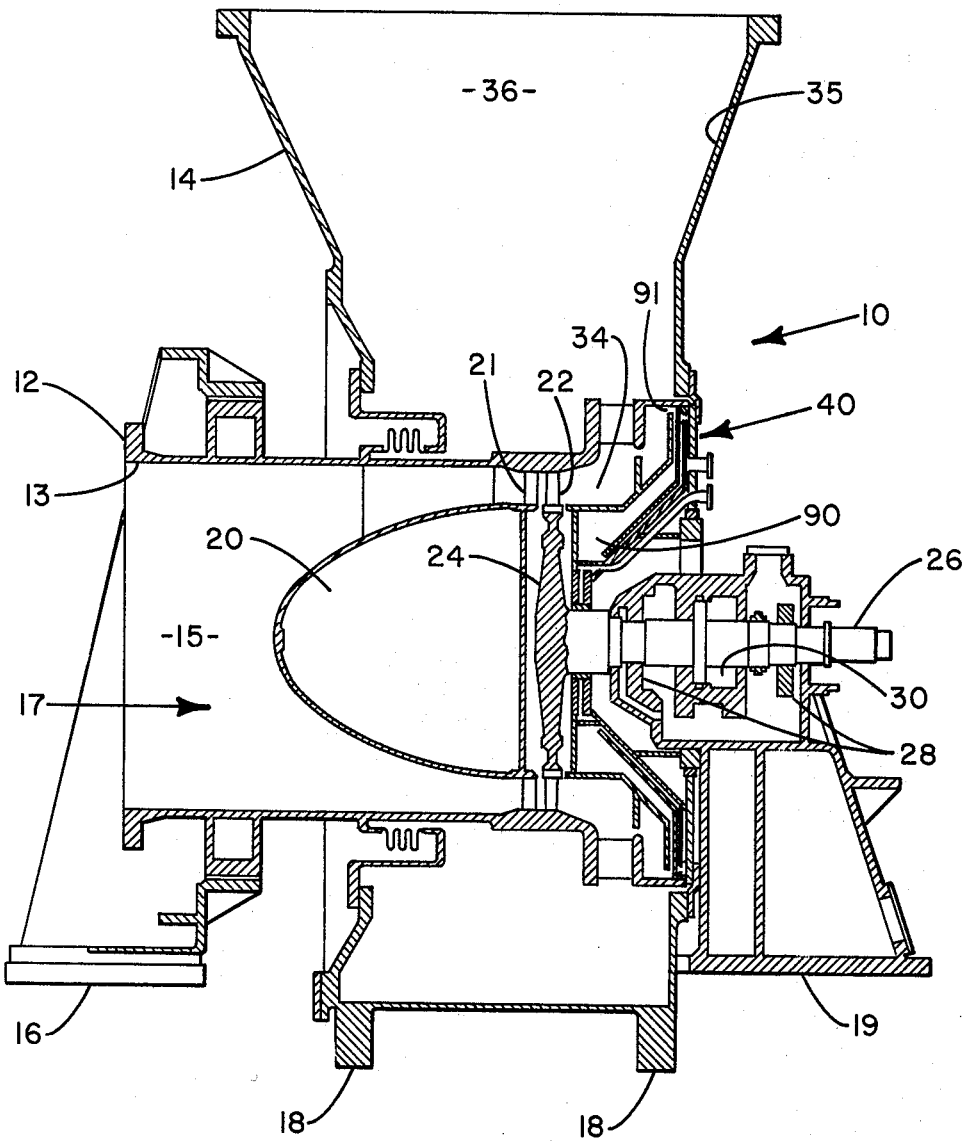
FIG. 1 is a longitudinal sectional illustration of a turbomachine embodying the present invention.

Referring particularly to FIG. 1, there is disclosed a turbomachine 10 including the novel invention, the details of which will be described in detail hereinafter. Turbomachine 10 includes main casing 12 suitably connected by a sliding bolted joint or similar means to exhaust casing 14. If desired, casings 12 and 14 may be made from a single unitary structure. Casing 12 is shaped in a generally cylindrical configuration. Inner surface 13 of casing 12 defines an annular chamber 15 into which gas is admitted. The gas flows in the direction indicated by arrow 17; the gas preferably being a "waste" gas from a process.

Suitably connected at the front portion of main casing 12 is a front pedestal or support 16. A second bearing pedestal or support 19 is attached by means of a bolted slip joint to exhaust casing 14. Bearing pedestal 19 also supports backplate 40 through a suitable rigid bolted joint. Backplate 40 in turn supports casing 12 through a radial pin ring which is slotted to permit axial growth. Casing 14 has its own side pedestal supports and is aligned by central key supports 18. The pedestals 16 and 19 provide rigid axial alignment support for casing 12 and the rotor contained therein of turbomachine 10. The pedestals typically rest on a foundation in the building in which machine 10 is located.

A nose cone 20 is suitably positioned within the path of flow of the gas moving through casing 12. Nose cone 20 directs the gas through a desired flow path through nozzle blades 21 into contact with rotor blades 22 mounted on disc 24. Disc 24 is attached to shaft 26. The combined structure of the shaft and disc defines the rotor section of the turbomachine. Shaft 26 is suitably journaled by bearings 28 provided with pedestal 19. Preferably, thrust bearing 30 is also provided in bearing pedestal 19 to axially locate shaft 26 for reasons obvious to those skilled in the art. The motivating gas, after passing in contact with blades 22 of disc 24, exits from the main casing through diffuser 34 and passes radially therefrom into the exhaust passage 36 of exhaust casing 14. Exhaust passage or chamber 36 is defined by the inner wall 35 of casing 14. Exhaust passage 36 is considerably larger in volume when compared to supply chamber 15. The increased size is required since the gas is substantially expanded as a result of its passage through blades 21 and 22. The passage of the gas through the rotor blades causes the rotor section of machine 10 to rotate and thereby deliver power to a machine such as a compressor or generator connected to shaft 26.

Figure 2:
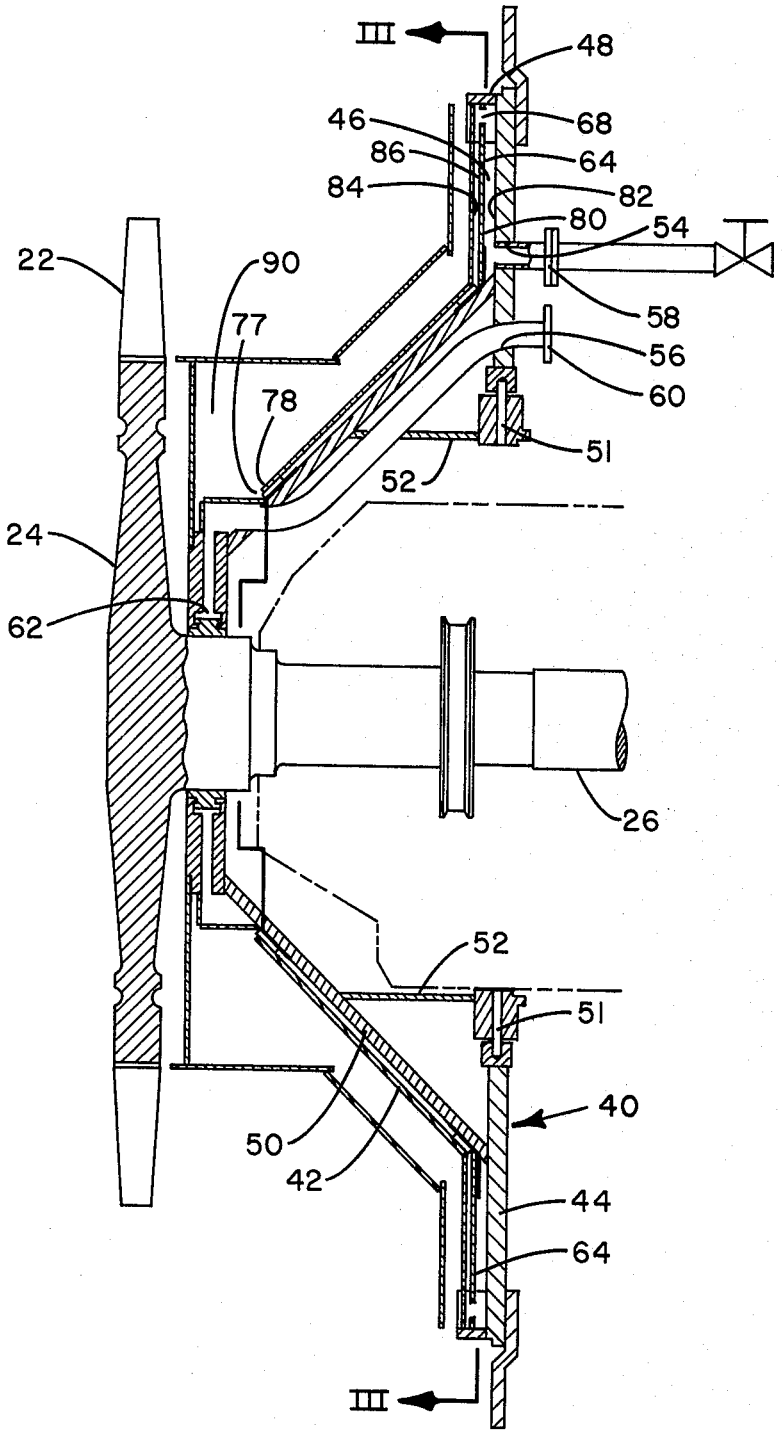
FIG. 2 is an enlarged sectional view of a preferred embodiment of the instant invention.
Figure 3:
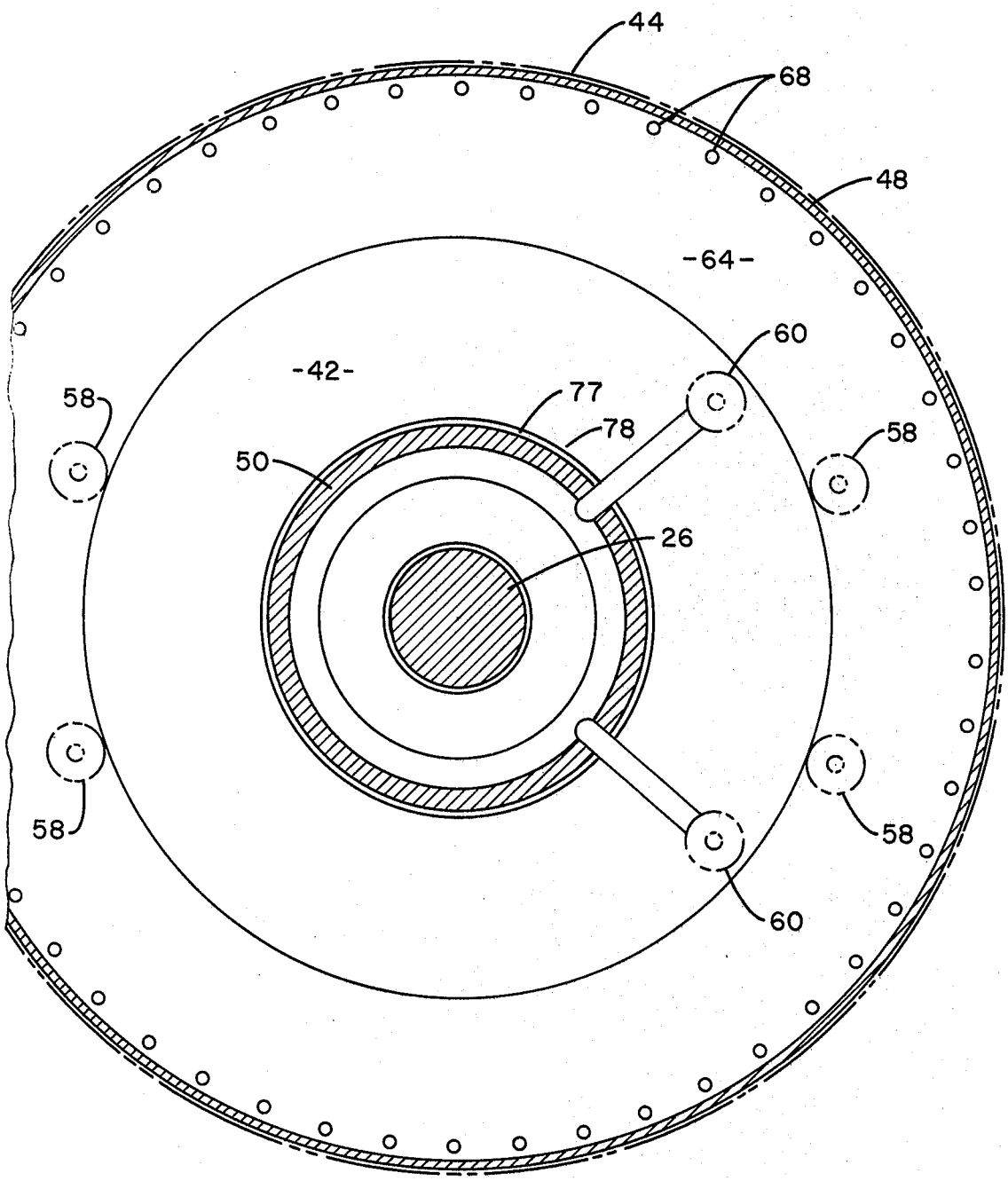
FIG. 3 is a partial sectional view, taken along the line III—III of FIG. 2.

Referring now in particular to FIGS. 2 and 3, there is illustrated an enlarged view of the present invention as employed in turbomachine 10 of FIG. 1. In particular, backplate 40 is provided to seal exhaust casing 14 and locate the end of casing 12 opposite from the gas inlet chamber thereof. Backplate 40 includes spaced, opposed front and rear radially extending walls 42 and 44 respectively. Walls 42 and 44 are suitably solidly connected at their outer diameter to define therebetween chamber 46. The front and rear walls are joined by circular outer wall 48. Front wall 42 is free to move independently of rear wall 44. Although the backplate may be machined from several single pieces of metal, and bolted together it is preferable to manufacture the backplate as a weldment.

Backplate 40 further includes axial struts 52 connected to rear wall 44 by radial guide pins or dowels 51 to provide radial growth flexibility. Backplate 40 may be attached to exhaust casing 14, by studs or similar means. The backplate is "rabbited" and keyed to bearing pedestal 19 so that the backplate is mounted and maintained concentric with respect to shaft 26. Openings 54 and 56 are provided in rear wall 44 of the backplate. As illustrated in FIG. 3, preferably four nozzles 58 are provided in respective openings 54 to permit the passage of a cooling medium, for example steam, into chamber 46 defined between front and rear walls 42 and 44. Conduits 60 are suitably connected to openings 56 to permit the passage of a sealing gas, for example steam, for sealing purposes. The sealing gas is directed to a labyrinth type seal 62. A baffle member 64 extends radially within chamber 46. The top surface of the baffle member includes a plurality of equally spaced, circumferentially and axially extending orifices 68 (See FIG. 3) which define a flow path for the cooling medium. It is necessary to provide the cooling medium to reduce the temperature of the backplate and other components of the turbomachine due to the relatively high temperatures, for example 1,000° – 1,200° F, at which the motivating gas may be supplied. Since the temperature of the backplate and other components may approach the critical point, it is necessary that any moisture that might be entrained in the cooling medium either be eliminated, or spread over a relatively large surface area to avoid localized distortion.

Backplate 40 not only functions as a sealing member for one end of exhaust casing 14, but in addition, functions as a part of an assembly providing for the admission of the cooling medium employed to maintain the temperature of various components below their critical temperature.

Figure 4:
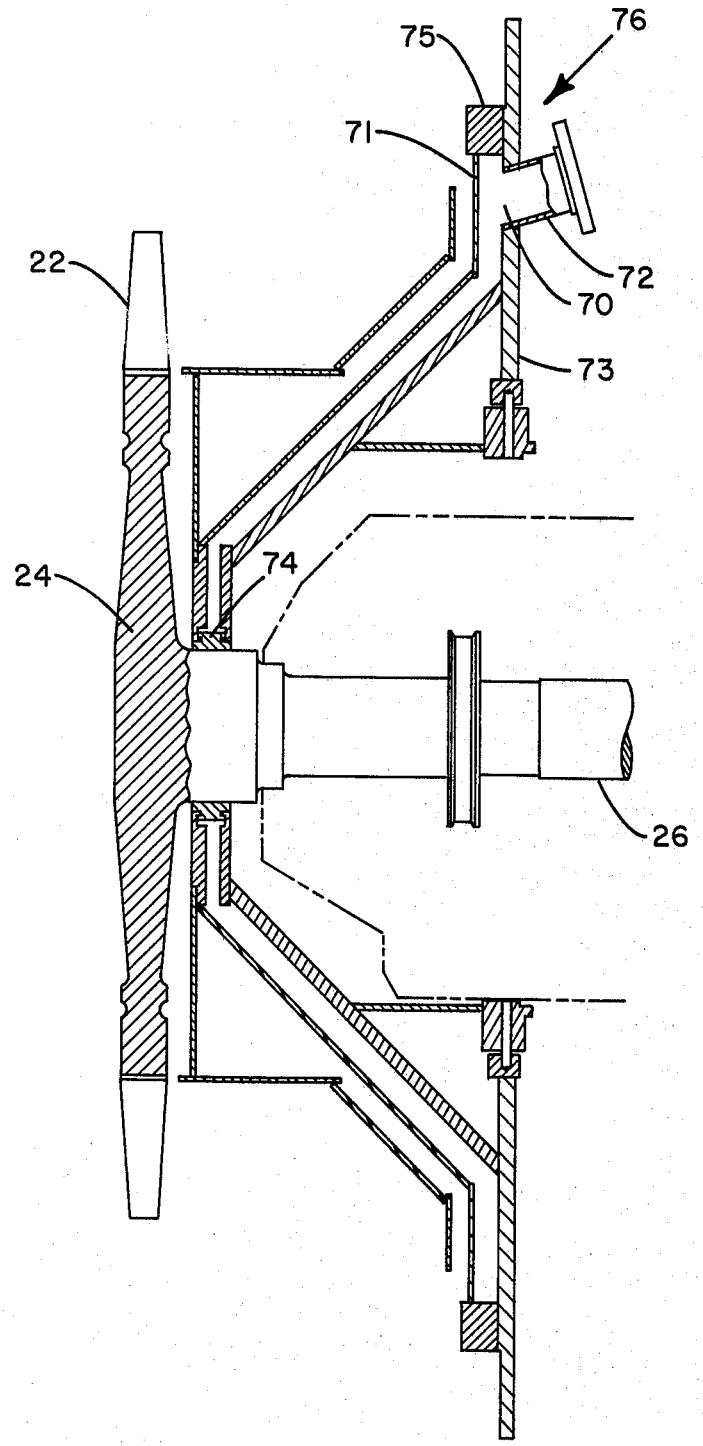
FIG. 4 PRIOR ART
FIG. 4 is an enlarged sectional view illustrating the prior art.

Referring now to FIG. 4, there is disclosed a turbomachine having a cooling medium admission assembly in accordance with the prior art. Heretofore, as illustrated in FIG. 4, the cooling medium has been injected into a pressurized chamber 70 defined by radially extending front and rear walls 71 and 73, top wall 75, and labyrinth 74. Since chamber 70 was pressurized, the steam employed as the cooling medium would not undergo a substantial drop in pressure when admitted into chamber 70. Accordingly, any moisture entrained in the steam, would not flash into steam upon admission into chamber 70. In addition, the steam admitted into chamber 70 via nozzle 72 would be directed directly against front wall 71 of the backplate 76 of the prior art. Thus, any moisture entrained in the steam would come into direct contact with a relatively small surface area of the front wall of the backplate to thereby create possible localized distortion. The localized distortion might result from the water particles contacting a relatively small surface area, which would create internal stresses due to the substantial temperature reduction that might occur at the particular point of contact. The steam could only escape from chamber 70 through labyrinth 74.

To obviate the foregoing problems, as illustrated in FIGS. 2 and 3, front wall 42 of backplate 40 has been provided with an opening or circular gap 77 at its lower end 78. Opening 77 permits the cooling medium to readily escape from chamber 46 to the atmosphere via chamber 90, gap 91, and exhaust passage 36. The cooling medium may thereafter be employed to cool the disc 24 of the rotor. Thus, chamber 46 is essentially at atmospheric pressure. In addition, opening 77 permits front wall 42 to radially expand upon any increase in temperature thereof due to the relatively high temperature of the motivating "waste" gas.

It is essential that the critical flow point be at nozzle 58 to insure that the cooling medium is substantially placed in a superheated state upon entrance into chamber 46. This will cause any moisture entrained in the saturated cooling steam to be flashed into steam. To obtain this desirable feature, the area of circular gap 77 and orifices 68 must be greater than the total area of the four inlet expansion nozzles 58. Through the remainder of the path of flow through chamber 46, it is desirable to maintain the velocity of the cooling medium at 0.3 to 0.5 times the velocity of the medium through nozzles 58 to obtain adequate convection cooling of wall 42. However, even if a small quantity of moisture remains in the steam after the steam enters chamber 46, baffle member 64 will direct the cooling medium to the outer diameter of chamber 46 so that it will pass over a relatively large surface area of front and rear walls 42 and 44 of the backplate 40 to thereby prevent localized distortion. In particular, any moisture still remaining in the cooling medium subsequent to admission into chamber 46, will be distributed over a relatively large surface area as the cooling medium flows through the flow path in the manner directed by baffle member 64. The cooling medium will be directed by baffle member 64 through the path defined successively between first surface 80 of the baffle member and an inner surface 82 of rear wall 44, through equally spaced orifices 68, in baffle 64, and between a second surface 86 of baffle member 64 and inner surface 84 of front wall 42. The path between surfaces 84 and 86 is maintained at a minimum width to increase the velocity of the cooling medium to obtain the desired convection cooling of wall 42.

In effect, the area defined by circular gap 77 and orifices 68 is substantially greater than the total area defined by nozzles 58. This insures that the velocity through nozzles 58 will be at a larger magnitude when compared to the velocity through orifices 68 and gap 77 and that the pressure thereat will be minimal to promote the flashing of any moisture entrained in the steam admitted into chamber 46.

The structure heretofore described defines an admission assembly for a cooling medium which will avoid subjecting the components of the turbomachine to excessive moisture whereby localized distortion will be prevented. Any moisture entrained in the cooling medium will be distributed over a relatively large surface area. In addition, the velocity of the cooling medium is maintained sufficiently large to promote effective convection cooling of wall 42.

While a preferred embodiment of the present invention has been described and illustrated, the invention should not be limited thereto but may be otherwise embodied within the scope of the following claims.

We claim:

1. An assembly for admitting a cooling inert gas in a saturated state into a turbomachine operating at relatively high temperatures comprising:

a first member having spaced, opposed front and rear radially extending walls defining a chamber therebetween;

a baffle member extending radially within said chamber defined by said spaced walls, the top surface of said baffle member including a plurality of orifices defining a fluid flow path through said baffle member; and at least one fluid expansion nozzle provided in a selected one of the opposed walls of said first member to define an entrance path for the saturated cooling insert gas being expanded upon discharge from said nozzle into a substantially superheated gas, said cooling gas successively passing between the inner surface of said selected one wall and a first surface of said baffle member, said orifices, and between the inner surface of said other wall and a second surface of said baffle member, the lower surface of said other wall defining a top surface of an outlet to permit said cooling gas to pass from said assembly.

2. An assembly in accordance with claim 1 wherein said baffle member distributes any moisture entrained in said cooling gas after expansion through said nozzle over a relatively large surface area of said front and rear walls of said first member.

3. In a turbomachine having a casing, inlet means to permit the passage of a motivating fluid into said casing, rotor means in the path of flow of said motivating fluid, and exit means to permit the motivating fluid to pass from said casing after contacting said rotor means, the improvement comprising:

a structure for sealing one end of said casing comprising a first member having spaced, opposed front and rear radially extending walls concentrically mounted with respect to and spaced from a shaft of said rotor means; a baffle member extending radially within a chamber defined by said spaced walls, the top surface of said baffle member including a plurality of equally spaced orifices defining a fluid flow path through said baffle member, and at least one fluid expansion nozzle provided in said rear wall to define an entrance path for a substantially saturated inert gas to be employed for cooling purposes, said cooling inert gas becoming a substantially superheated gas upon discharge from said nozzle, said gas successively passing between said rear walll and a first face of said baffle member, said orifices and between said front wall and a second face of said baffle member, the lower surface of said front wall defining the top surface of an opening to permit said cooling gas to pass from said first member.

4. The combination in accordance with claim 3 wherein said baffle member distributes any moisture entrained in said cooling inert gas after expansion through said nozzle over a relatively large surface area of said front and rear walls of said first member.

5. The combination in accordance with claim 4 wherein the total area of said exit opening from said chamber is greater than the total area of said injection nozzle.

6. In a turbomachine having a casing, inlet means to permit the passage of motivating fluid into said casing, rotor means in the path of flow of said motivating fluid and exit means to permit said motivating fluid to pass from said casing after contacting said rotor means, the improvement comprising:

an assembly for sealing one end of said casing including one wall in heat transfer relation with said motivating fluid, said wall defining one side of an expansion chamber; at least one fluid expansion nozzle provided in another wall of said chamber to define an entrance path for an inert gas in a substantially saturated state employed to cool said assembly, the pressure of said cooling gas being reduced upon introduction into said expansion chamber to place said gas into a substantially superheated state; baffle means extending within said chamber to direct said cooling gas through an elongated flow path within said chamber; and exit means communicating said chamber with the ambient to permit said cooling gas to be exhausted from said chamber to the atmosphere.

7. The combination in accordance with claim 6 wherein the total area of said exit opening from said chamber is greater than the total area of said injection nozzle.

* * * * *